US010415863B2

(12) United States Patent
Kim et al.

(10) Patent No.: US 10,415,863 B2
(45) Date of Patent: Sep. 17, 2019

(54) COMPRESSOR CONTROL APPARATUS AND METHOD FOR VEHICLE

(71) Applicants: Hyundai Motor Company, Seoul (KR); Kia Motors Corporation, Seoul (KR)

(72) Inventors: Yeong Jun Kim, Gyeonggi-do (KR); Yangbo Kang, Gyeonggi-do (KR); Jeongbin Park, Gyeonggi-do (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 246 days.

(21) Appl. No.: 15/258,580

(22) Filed: Sep. 7, 2016

(65) Prior Publication Data

US 2017/0284719 A1 Oct. 5, 2017

(30) Foreign Application Priority Data

Mar. 31, 2016 (KR) ..... 10-2016-0039407

(51) Int. Cl.
*F25B 49/02* (2006.01)
*F25B 31/02* (2006.01)

(52) U.S. Cl.
CPC ..... *F25B 49/022* (2013.01); *F25B 31/02* (2013.01); *F25B 2600/022* (2013.01); *F25B 2700/21* (2013.01)

(58) Field of Classification Search
CPC ..... F25B 49/022; F25B 31/00; F25B 2700/21
See application file for complete search history.

(56) References Cited

U.S. PATENT DOCUMENTS

2002/0157414 A1* 10/2002 Iwanami ..... B60H 1/00778 62/239

FOREIGN PATENT DOCUMENTS

| | | | |
|---|---|---|---|
| CN | 1193095 | A | 9/1998 |
| EP | 0865152 | A1 | 9/1998 |
| JP | 05-050845 | A | 3/1993 |
| KR | 10-2012-0126642 | A | 11/2012 |
| KR | 10-2013-0075066 | A | 7/2013 |

* cited by examiner

*Primary Examiner* — Ljiljana V. Ciric
*Assistant Examiner* — Alexis K Cox
(74) *Attorney, Agent, or Firm* — Mintz Levin Cohn Ferris Glovsky and Popeo, P.C.; Peter F. Corless

(57) ABSTRACT

A compressor control apparatus for a vehicle includes: a compressor configured to compress coolant of an air conditioner; a coolant temperature measurement unit configured to measure a coolant temperature; a data detector configured to detect state data for controlling the compressor; and a controller configured to determine an operation rate of the compressor based on the coolant temperature and the state data, and operate the compressor based on the operation rate of the compressor.

6 Claims, 4 Drawing Sheets

COMPRESSOR CONTROL APPARATUS AND METHOD FOR VEHICLE

CROSS-REFERENCE TO RELATED APPLICATION

This application claims under 35 U.S.C. § 119(a) the benefit of Korean Patent Application No. 10-2016-0039407 filed in the Korean Intellectual Property Office on Mar. 31, 2016, the entire contents of which are incorporated herein by reference.

BACKGROUND

(a) Technical Field

The present invention relates to a compressor control apparatus for a vehicle.

(b) Description of the Related Art

In general, an engine of a vehicle generates a large amount of heat. When a temperature of the engine rises at or above a certain level, explosion is likely to occur. Thus, in order to cool the engine, coolant for lowering the temperature is circulated around the engine. Heated coolant radiates heat through a radiator, and a cooling fan is installed in an engine room of the vehicle in order to raise a heat radiation effect of the radiator.

In warm temperatures, when a vehicle travels at high speed along a mountain road or a vehicle tows a trailer and travels with an air conditioner turned on, the engine must be excessively operated. Thus, a coolant temperature of the engine continuously rises. When the coolant temperature rises, the engine may be over-heated.

In order to prevent the over-heating of the engine, a BLDC (Brushless Direct Current) motor or a high-capacity motor is utilized in a cooling fan mounted on a radiator in Europe and North America, and a dual fan is utilized in Japan. When the BLDC motor, the high-capacity motor and the dual fan are utilized, the material cost increases, and the weight of the vehicle increases.

In the related art, when the coolant temperature rises to a preset temperature, operation of the air conditioner is stopped. Then, when the coolant temperature falls to a specific temperature due to an operation stop of the air conditioner, the air conditioner is turned on to prevent overheating of the engine. Since the air conditioner is controlled to be repetitively turned on/off according to the coolant temperature, the durability of the engine and the compressor is deteriorated.

In the related art, when the air conditioner is turned off to control the coolant temperature, an indoor temperature of the vehicle rises. Thus, a driver may feel uncomfortable, and moisture on windows cannot be removed. This moisture on the windows frequently occurs when the outdoor temperature falls while the vehicle travels along a mountain road, thereby having a negative influence on operation safety of vehicle occupants.

This background information is provided for the purpose of making known information believed by the applicant to be of possible relevance to the present invention. No admission is necessarily intended, nor should be construed, that the preceding information constitutes prior art against the present invention.

SUMMARY

The present invention provides a compressor control apparatus and method for a vehicle, which controls a coolant temperature by controlling an operation rate of a compressor when a vehicle state falls within a worst stress condition.

Further, another embodiment of the present invention provides a compressor control apparatus and method for a vehicle, which controls a coolant temperature by lowering an operation rate of a compressor in order to prevent over-heating of an engine and operation stop of the compressor.

An exemplary embodiment of the present invention provides a compressor control apparatus for a vehicle, including: a compressor configured to compress coolant of an air conditioner; a coolant temperature measurement unit configured to measure a coolant temperature; a data detector configured to detect state data for controlling the compressor; and a controller configured to determine an operation rate of the compressor based on the coolant temperature and the state data, and operate the compressor based on the operation rate of the compressor. When the state data satisfy a worst stress condition, the controller may determine whether the coolant temperature is greater than or equal to a first reference value, and when the coolant temperature is greater than or equal to the first reference value, the controller may lower the operation rate of the compressor.

The worst stress condition may be satisfied when an outdoor temperature is greater than or equal to a preset temperature, an air volume level of the air conditioner is greater than or equal to a preset level, and a position value of an accelerator pedal is greater than or equal to a preset position value.

When the coolant temperature is greater than or equal to the first reference value, the controller may determine the operation rate of the compressor using a first control map in which the operation rate of the compressor is set according to the coolant temperature.

When the state data do not satisfy the worst stress condition, the controller may determine whether the coolant temperature is greater than or equal to a second reference value, and when the coolant temperature is greater than or equal to the second reference value, the controller may lower the operation rate of the compressor. The second reference value may be larger than the first reference value.

The state data may include an outdoor temperature, an air volume level of the air conditioner, and a position value of an accelerator pedal.

The data detector may include: an outdoor temperature sensor configured to measure an outdoor temperature; an accelerator position sensor (APS) configured to measure the position value of the accelerator pedal; and an air volume sensor configured to measure the air volume level of the air conditioner.

Another exemplary embodiment of the present invention provides a compressor control method for a vehicle, including steps of: detecting state data when an air conditioner is turned on; determining whether the state data satisfy a worst stress condition; when the state data satisfy the worst stress condition, comparing a coolant temperature to a first reference value; lowering an operation rate of the compressor when the coolant temperature is greater than or equal to the first reference value; and operating the compressor based on the compressor operation rate.

The step of determining whether the state data satisfy the worst stress condition may include steps of: determining whether an outdoor temperature is greater than or equal to a preset temperature; determining whether an air volume level of the air conditioner is greater than or equal to a preset level; and determining whether a position value of an accelerator pedal is greater than or equal to a preset position value.

The worst stress condition may be satisfied when an outdoor temperature is greater than or equal to a preset temperature, an air volume level of the air conditioner is greater than or equal to a preset level, and a position value of an accelerator pedal is greater than or equal to a preset position value.

The step of lowering the operation rate when the coolant temperature is greater than or equal to the first reference value may include determining the operation rate using a first control map in which a compressor operation rate is set according to a coolant temperature, when the coolant temperature is greater than or equal to the first reference value.

The compressor control method may further include steps of: comparing the coolant temperature to a second reference value when the state data do not satisfy the worst stress condition; and lowering the operation rate when the coolant temperature is greater than or equal to the second reference value.

The second reference value may be larger than the first reference value.

Another exemplary embodiment of the present invention provides a non-transitory computer readable medium containing program instructions executed by a processor, the computer readable medium including: program instructions that detect state data when an air conditioner is turned on; program instructions that determine whether the state data satisfy a worst stress condition; program instructions that compare a coolant temperature to a first reference value, when the state data satisfy the worst stress condition; program instructions that lower an operation rate of a compressor when the coolant temperature is greater than or equal to the first reference value; and program instructions that operate the compressor based on the operation rate.

According to the exemplary embodiments of the present invention, when the vehicle state falls within the worst stress condition, the compressor control apparatus and method may not stop the operation of the compressor, but control the coolant temperature by lowering the operation rate of the compressor. Therefore, the durability of the engine and the compressor can be improved, and over-heating of the engine can be prevented.

Further, since the compressor control apparatus and method can control the coolant temperature without adding separate hardware, any increases in material costs and weight can be prevented, and fuel efficiency can be improved.

The other effects which can be obtained or expected by the exemplary embodiments of the present invention will be directly or implicitly disclosed in the detailed descriptions of the present invention. That is, various effects which are expected according to the exemplary embodiments of the present invention will be disclosed in the detailed descriptions of the present invention.

DETAILED DESCRIPTION OF THE EMBODIMENTS

Figure 1:
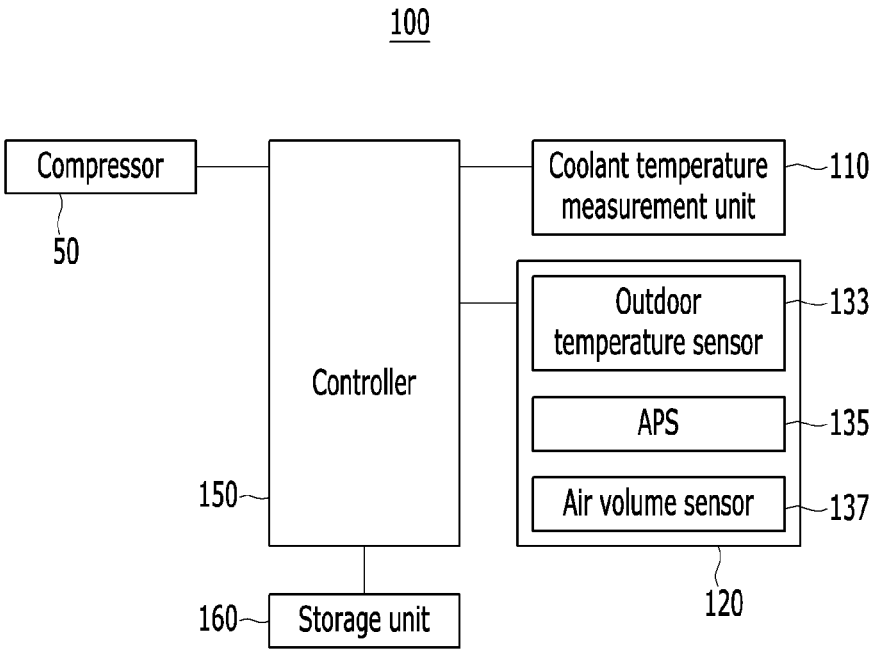
FIG. 1 is a schematic diagram illustrating a compressor control apparatus for a vehicle according to an exemplary embodiment of the present invention.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Throughout the specification, unless explicitly described to the contrary, the word "comprise" and variations such as "comprises" or "comprising" will be understood to imply the inclusion of stated elements but not the exclusion of any other elements. In addition, the terms "unit", "-er", "-or", and "module" described in the specification mean units for processing at least one function and operation, and can be implemented by hardware components or software components and combinations thereof.

Further, the control logic of the present invention may be embodied as non-transitory computer readable media on a computer readable medium containing executable program instructions executed by a processor, controller or the like. Examples of computer readable media include, but are not limited to, ROM, RAM, compact disc (CD)-ROMs, magnetic tapes, floppy disks, flash drives, smart cards and optical data storage devices. The computer readable medium can also be distributed in network coupled computer systems so that the computer readable media is stored and executed in a distributed fashion, e.g., by a telematics server or a Controller Area Network (CAN).

Hereafter, the operation principle of a compressor control apparatus and method for a vehicle according to an exemplary embodiment of the present invention will be described in detail with reference to the accompanying drawings. However, the following drawings and detailed descriptions relate to one exemplary embodiment among a variety of exemplary embodiments for effectively describing the features of the present invention. Therefore, the present invention is not limited to the drawings and the detailed descriptions.

Hereafter, an exemplary embodiment of the present invention will be described in detail as follows with reference to the accompanying drawings.

FIG. 1 is a schematic diagram illustrating a compressor control apparatus for a vehicle according to an exemplary embodiment of the present invention.

Referring to FIG. 1, the compressor control apparatus 100 according to the exemplary embodiment of the present invention includes a compressor 50, a coolant temperature measurement unit 110, a data detector 120, a controller 150, and a storage unit 160.

The compressor 50 actuates an air conditioner by compressing coolant existing in the air conditioner at high temperature and high pressure. The compressor 50 may be operated according to an operation rate determined by the controller 150. As the operation rate of the compressor 50 is increased, the cooling performance of the air conditioner is increased.

The coolant temperature measurement unit 110 measures the temperature of coolant, and provides the measured coolant temperature to the controller 150.

The data detector 120 detects state data for controlling the compressor 50. The data detector 120 includes an outdoor temperature sensor 133, an accelerator position sensor (APS) 135 and an air volume sensor 137.

The outdoor temperature sensor 133 measures an outdoor temperature of air outside the vehicle. The outdoor temperature sensor 133 provides the measured outdoor temperature to the controller 150.

The APS 135 measures the extent that a driver steps down an accelerator pedal. The APS 135 measures the position value of the accelerator pedal (the extent that the accelerator pedal is depressed), and provides the measured position value to the controller 150. When the accelerator pedal is completely depressed, the position value of the accelerator pedal is 100%, and when the accelerator pedal is not depressed, the position value of the accelerator pedal is 0%. Instead of the APS 135, a throttle valve opening detector mounted on an intake path may be used.

The air volume sensor 137 measures the level of the air volume of the air conditioner, and provides the measured level to the controller 150.

The controller 150 controls the operation of the compressor 50, the coolant temperature measurement unit 110, the data detector 120, and the storage unit 160. The controller 150 receives the state data from the data detector 120. The state data for controlling the compressor 50 include an outdoor temperature, a position value of the accelerator pedal, and an air volume level of the air conditioner.

When the state data satisfy the worst stress condition, the controller 150 checks the coolant temperature measured through the coolant temperature measurement unit 110. The controller 150 checks whether the coolant temperature is greater than or equal to a first reference value. The first reference value may indicate a reference value for lowering the operation rate of the compressor 50, and be set to 108° C. When the coolant temperature is greater than or equal to the first reference value, the controller 150 determines the compressor operation rate according to the coolant temperature. The controller 150 controls the operation of the compressor 50 based on the compressor operation rate.

The controller 150 may include one or more microprocessors which are operated by a predetermined program, and the predetermined program may include a series of commands for performing the respective steps included in a compressor control method according to an exemplary embodiment of the present invention, which will be described below. The compressor control method will be described in detail with reference to FIGS. 2 to 4.

The storage unit 160 stores data required by the constituent elements of the compressor control apparatus 100 and data generated by the constituent elements of the compressor control apparatus 100. For example, the storage unit 160 may store the state data measured by the data detector 120. The storage unit 160 may store a compressor operation rate based on the first reference value and the coolant temperature. The storage unit 160 may store various programs for controlling overall operations of the compressor control apparatus 100.

The storage unit 160 may provide necessary data according to the requests of the compressor 50, the coolant temperature measurement unit 110, the data detector 120, and the controller 150. The storage unit 160 may be implemented with an integrated memory or divided into a plurality of memories. For example, the storage unit 160 may include read only memory (ROM), random access memory (RAM), and flash memory.

Hereafter, a compressor control method for a vehicle according to an exemplary embodiment of the present invention will be described with reference to FIGS. 2 to 4.

Figure 2:
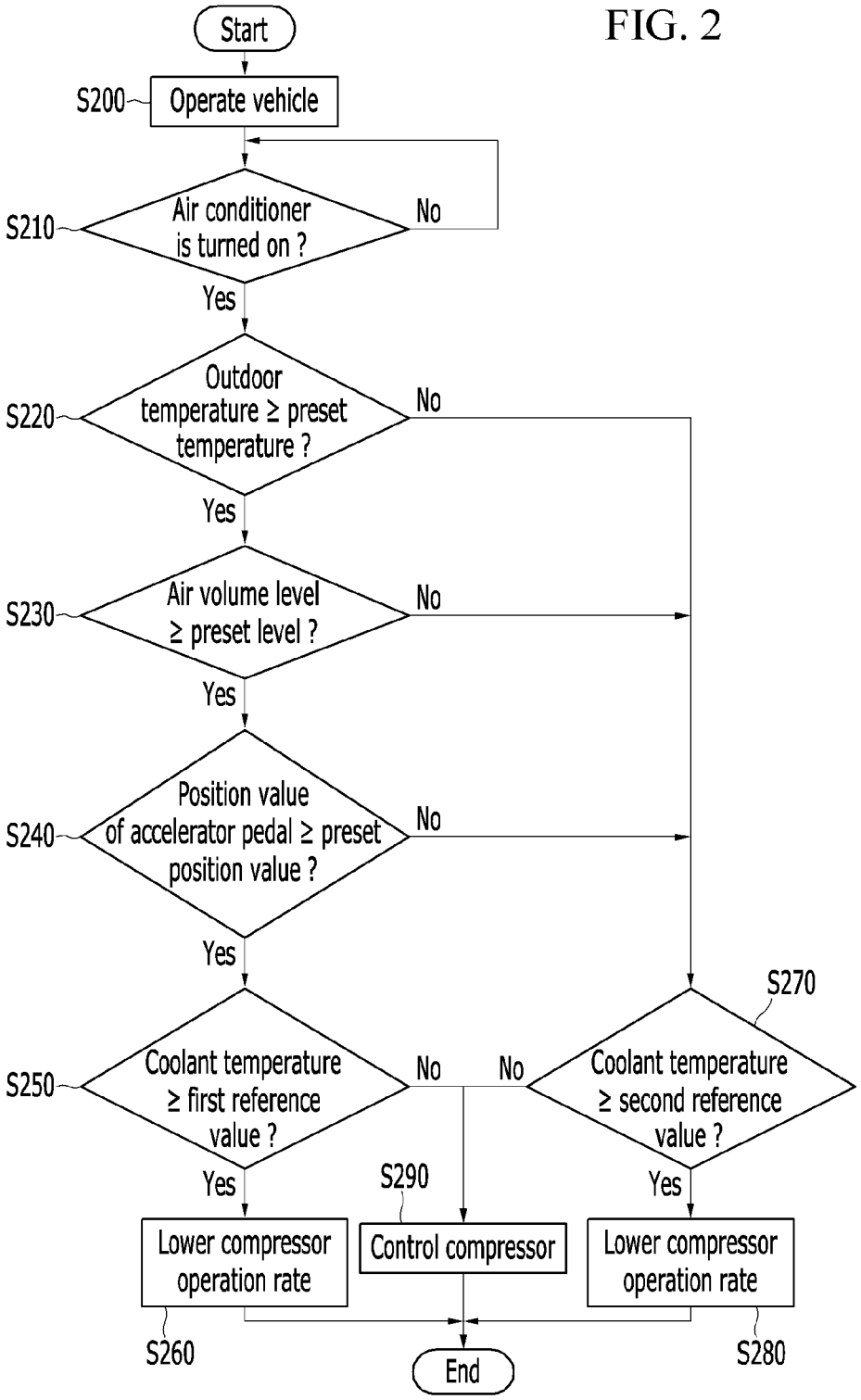
FIG. 2 is a flowchart illustrating a compressor control method for a vehicle according to an exemplary embodiment of the present invention.
Figure 3:
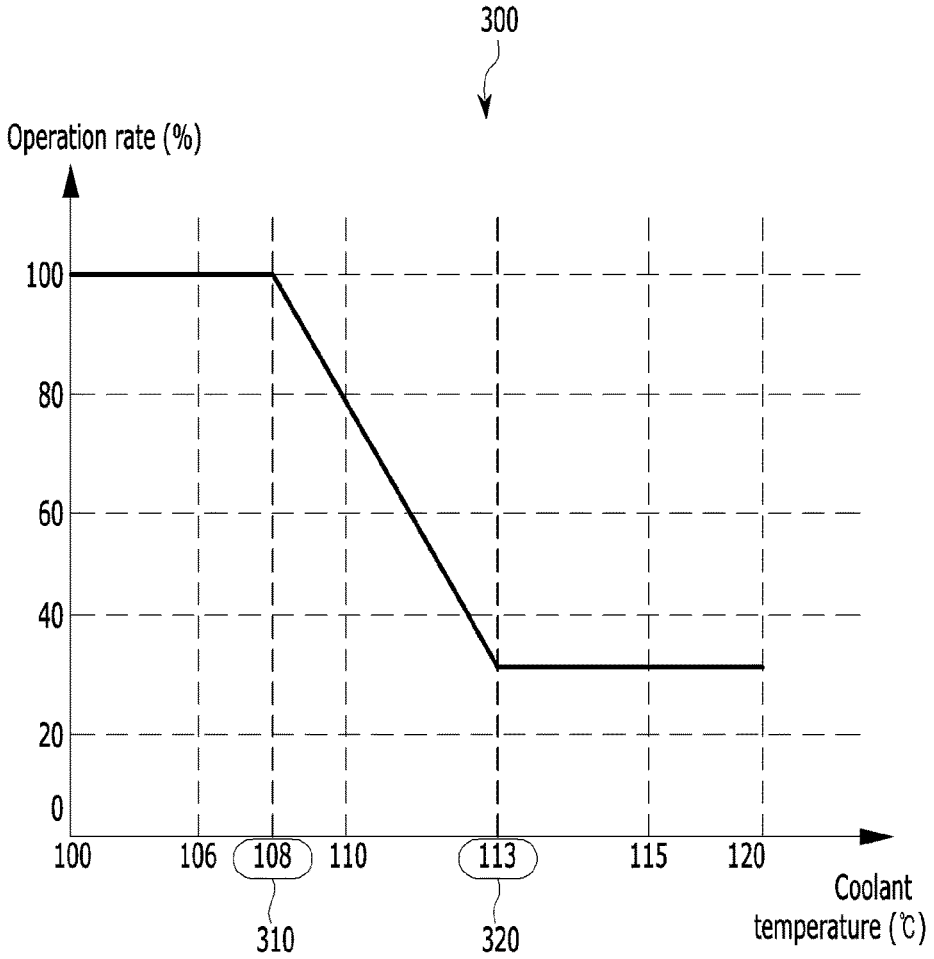
FIG. 3 is a diagram illustrating a first control map according to the exemplary embodiment of the present invention.
Figure 4:
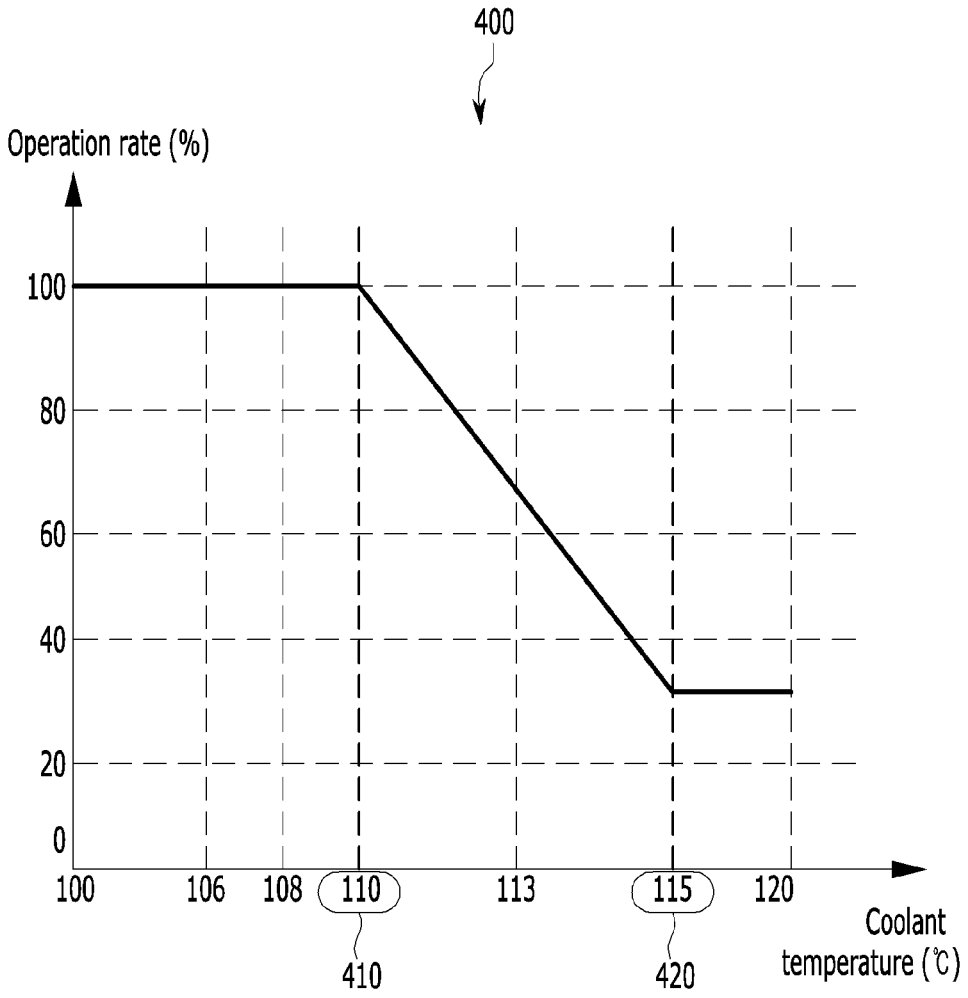
FIG. 4 is a diagram illustrating a second control map according to the exemplary embodiment of the present invention.

FIG. 2 is a flowchart illustrating the compressor control method for a vehicle according to the exemplary embodiment of the present invention, FIG. 3 is a diagram illustrating a first control map according to the exemplary embodiment of the present invention, and FIG. 4 is a diagram illustrating a second control map according to the exemplary embodiment of the present invention.

Referring to FIG. 2, the controller 150 operates the vehicle when the driver turns on the ignition (S200). The controller 150 may receive a signal from an ignition detector (not illustrated), and check whether the ignition is turned on. When the ignition is turned on, the controller 150 may operate the vehicle according to the request of the driver.

The controller 150 checks whether the air conditioner is turned on (S210). That is, the controller 150 checks whether the air conditioner is turned on through an air conditioner switch. The air conditioner switch may be turned on by the driver.

When the air conditioner is in an off state, the controller 150 returns to step S210 to monitor whether the air conditioner is turned on.

The controller 150 determines whether the state data satisfy the worst stress condition (S220 to S240). Specifically, the controller 150 may determine whether the engine and the air conditioner are operated in a heavy load state. Steps S220 to S240 may be performed at the same time or in any order.

The controller 150 determines whether the outdoor temperature is greater than or equal to a preset temperature, when the air conditioner is turned on (S220). The controller 150 receives an outdoor temperature from the outdoor temperature sensor 133, and checks whether the received outdoor temperature is greater than or equal to the preset temperature. The preset temperature may be set by a prespecified algorithm (for example, program and probability model) or set by an operator. The preset temperature may be set to 20° C., for example.

When the outdoor temperature is greater than or equal to the preset temperature, the controller 150 determines whether the air volume level of the air conditioner is greater than or equal to a preset level (s230). The preset level may indicate the reference air volume level of the air conditioner, which is used to check whether an air volume level falls within the worst stress condition, and includes a manually set level and an automatically set level. The manually set level may indicate an air volume level which is manually set by a driver through an apparatus for adjusting the air volume level of the air conditioner. The automatically set level may indicate a preset level which is used when the air volume level of the air conditioner is automatically set by an indoor temperature and an outdoor temperature. That is, the manually set level may indicate a level which is set through manual temperature control (MTC), and the automatically set level may indicate a level which is set through full automatic temperature control (FATC). The manually set level and the automatically set level may be different from each other. For example, the manually set level may be set to a third level, and the automatically set level may be set to a fifth level.

The controller 150 determines whether the position value of the accelerator pedal is greater than or equal to a preset position value, when the air volume level of the air conditioner is greater than or equal to the preset level (S240). When the air volume level of the air conditioner is greater than or equal to the preset level, the controller 150 checks the position value of the accelerator pedal, received from the APS 135, and determines whether the position value of the accelerator pedal is greater than or equal to the preset position value. As provided herein, the preset position value indicates the position value of the accelerator pedal, which is used as a reference value for checking whether a position value falls within the worst stress condition. The preset position value may be set through a pre-specified algorithm (for example, program and probability model) or set by an operator. The preset position value may be set to 30%, for example.

When the position value of the accelerator pedal is greater than or equal to the preset position value, the controller 150 checks whether the coolant temperature is greater than or equal to the first reference value (S250). The first reference value may indicate a value which is set to check whether the engine and the air conditioner are operated in a heavy load state. For example, the first reference value may be set to 108° C.

When the coolant temperature is greater than or equal to the first reference value, the controller 150 controls the operation of the compressor 50 by lowering the compressor operation rate (S260). As illustrated in FIG. 3, the controller 150 checks a compressor operation rate matched with the coolant temperature, in the first control map 300. The first control map may include operation rates of the compressor 50 which are set according to coolant temperatures. The first control map may include operation rates for coolant temperatures, which are set in the range of the first reference value 310 to a first predetermined value 320. The first predetermined value may indicate a coolant temperature for minimizing the operation rate of the compressor 50 when the engine and the air conditioner are operated in a heavy load state. The first predetermined value 320 may be set to 113° C. That is, the first control map 410 may indicate the operation rate of the compressor 50, which starts to be applied when the coolant temperature is greater than or equal to 108° C. and is minimized when the coolant temperature is 113° C.

When the state data do not satisfy the worst stress condition, the controller 150 determines whether the coolant temperature is equal to or higher than a second reference value (S270). In other words, when the outdoor temperature is less than the preset temperature, the air volume level of the air conditioner is less than the preset level, or the position value of the accelerator pedal is less than the preset position value, the controller 150 determines whether the coolant temperature is greater than or equal to the second reference value. The second reference value may be larger than the first reference value.

When the coolant temperature is greater than or equal to the second reference value, the controller 150 controls the operation of the compressor 50 by lowering the compressor operation rate (S280). As illustrated in FIG. 4, the controller 150 checks the compressor operation rate matched with the coolant temperature in the second control map 400. The second control map may include operation rates of the compressor 50, which are set according to coolant temperatures. The second control map may include operation rates for coolant temperature, which are set in the range of the second reference value 410 to a second predetermined value 420. The second predetermined value may indicate a coolant temperature for controlling the operation rate of the compressor 50 to the minimum operation rate in a general operation mode of the vehicle. The second reference value 410 may be set to 110° C., and the second predetermined value may be set to 115° C. That is, the second control map 400 may indicate the operation rate of the compressor 50, which starts to be applied when the coolant temperature is greater than or equal to 110° C., and is minimized when the coolant temperature is 115° C.

When the coolant temperature is less than the first reference value at step S250 or less than the second reference value at step S270, the controller 150 may not lower the compressor operation rate, but control the operation of the compressor 50 to 100% (S290).

As described above, the compressor control apparatus 100 according to the exemplary embodiment of the present invention may determine whether the engine and air conditioner are in a heavy load state, based on the outdoor temperature, the air volume level of the air conditioner and the position value of the accelerator pedal. When the engine and air conditioner are in a heavy load state according to the outdoor temperature, the air volume level of the air conditioner and the position value of the accelerator pedal, the compressor control apparatus 100 may not turn off the compressor 50 as in the related art, but control the compressor 50 by lowering the compressor operation rate. Therefore, since the operation of the air conditioner is not stopped, the deterioration in durability of the engine and the compressor 50 can be prevented, and the occurrence of moisture on the windows can be prevented.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A compressor control apparatus for a vehicle, comprising:

a compressor configured to compress coolant of an air conditioner;

a coolant temperature measurement unit configured to measure a coolant temperature;

a plurality of sensors configured to detect state data for controlling the compressor; and a controller configured to determine an operation rate of the compressor based on the coolant temperature and the state data, and operate the compressor based on the operation rate of the compressor, wherein when the state data satisfy a worst stress condition, the controller determines whether the coolant temperature is greater than or equal to a first reference value, wherein when the coolant temperature is greater than or equal to the first reference value, the controller lowers the operation rate of the compressor using a first control map in which the operation rate of the compressor is set according to the coolant temperature, wherein the state data comprise an outdoor temperature, an air volume level of the air conditioner, and a position value of an accelerator pedal, wherein the position value of the accelerator pedal ranges from 0% to 100%, such that a value of 0% indicates the accelerator pedal is not depressed, and a value of 100% indicates the accelerator pedal is completely depressed, wherein the worst stress condition is satisfied when the outdoor temperature is greater than or equal to a preset temperature, the air volume level of the air conditioner is greater than or equal to a preset level, and the position value of the accelerator pedal is greater than or equal to a preset position value, and wherein the preset position value is set through a prespecified algorithm or by an operator.

2. The compressor control apparatus of claim 1, wherein when the state data do not satisfy the worst stress condition, the controller determines whether the coolant temperature is greater than or equal to a second reference value, and when the coolant temperature is greater than or equal to the second reference value, the controller lowers the operation rate of the compressor, and the second reference value is larger than the first reference value.

3. The compressor control apparatus of claim 1, wherein the plurality of sensors comprises:

an outdoor temperature sensor configured to measure the outdoor temperature;

an accelerator position sensor (APS) configured to measure the position value of the accelerator pedal; and an air volume sensor configured to measure the air volume level of the air conditioner.

4. A compressor control method for a vehicle, comprising the steps of:

detecting, by a controller, state data when an air conditioner is turned on;

determining, by the controller, whether the state data satisfy a worst stress condition;

comparing, by the controller, a coolant temperature to a first reference value, when the state data satisfy the worst stress condition;

lowering, by the controller, an operation rate of a compressor when the coolant temperature is greater than or equal to the first reference value; and operating, by the controller, the compressor based on the operation rate, wherein when the coolant temperature is greater than or equal to the first reference value, the controller determines the operation rate of the compressor using a first control map in which the operation rate of the compressor is set according to the coolant temperature, and wherein the state data comprise an outdoor temperature, an air volume level of the air conditioner, and a position value of an accelerator pedal, wherein the step of determining whether the state data satisfy the worst stress condition comprises:

determining, by the controller, whether the outdoor temperature is greater than or equal to a preset temperature;

determining, by the controller, whether the air volume level of the air conditioner is greater than or equal to a preset level; and determining, by the controller, whether the position value of the accelerator pedal is greater than or equal to a preset position value, wherein the position value of the accelerator pedal ranges from 0% to 100%, such that a value of 0% indicates the accelerator pedal is not depressed, and a value of 100% indicates the accelerator pedal is completely depressed, wherein the worst stress condition is satisfied when the outdoor temperature is greater than or equal to the preset temperature, the air volume level of the air conditioner is greater than or equal to the preset level, and the position value of the accelerator pedal is greater than or equal to the preset position value, and wherein the preset position value is set through a prespecified algorithm or by an operator.

5. The compressor control method of claim 4, further comprising the steps of:

comparing, by the controller, the coolant temperature to a second reference value when the state data do not satisfy the worst stress condition; and lowering, by the controller, the operation rate when the coolant temperature is greater than or equal to the second reference value.

6. The compressor control method of claim 5, wherein the second reference value is larger than the first reference value.

* * * * *